US006050277A

United States Patent [19]

Purton et al.

[11] Patent Number: 6,050,277

[45] Date of Patent: Apr. 18, 2000

[54] DECOKING TOOL CARRIER WITH A SELF-PROPELLED CLIMBING CROSSHEAD

[75] Inventors: Robert M. Purton, Long Beach; Richard Tran, San Gabriel, both of Calif.

[73] Assignee: Ingersoll-Dresser Pump Company, Liberty Corner, N.J.

[21] Appl. No.: 09/188,746

[22] Filed: Nov. 9, 1998

[51] Int. Cl.[7] ..... B08B 3/02

[52] U.S. Cl. ..... 134/167 R; 134/181; 134/172; 134/198; 239/264

[58] Field of Search ..... 134/167 R, 172, 134/198, 201, 180, 181; 239/263.3, 264

[56] References Cited

U.S. PATENT DOCUMENTS

| | | | |
|---|---|---|---|
| 3,836,434 | 9/1974 | Novy | 201/2 |
| 3,880,359 | 4/1975 | Novy | 239/565 |
| 3,964,516 | 6/1976 | Purton et al. | 137/625.38 |
| 3,985,572 | 10/1976 | Petermann | 134/34 |
| 4,080,220 | 3/1978 | Neumann | 134/6 |
| 4,163,455 | 8/1979 | Hebert | 134/167 R |
| 4,275,842 | 6/1981 | Purton et al. | 239/446 |
| 4,611,613 | 9/1986 | Kaplan | 134/95 |
| 4,803,959 | 2/1989 | Sherrick | 122/379 |
| 4,959,126 | 9/1990 | Tong et al. | 201/2 |
| 5,076,893 | 12/1991 | Tong | 202/241 |
| 5,092,963 | 3/1992 | Barker et al. | 202/250 |
| 5,336,375 | 8/1994 | Wallskog et al. | 202/96 |
| 5,500,094 | 3/1996 | Fruchtbaum et al. | 202/241 |
| 5,579,787 | 12/1996 | Wood | 134/22.1 |

*Primary Examiner*—Frankie L. Stinson
*Attorney, Agent, or Firm*—Robert F. Palermo

[57] ABSTRACT

An apparatus for a decoking system, for raising and lowering a cutting tool into a coking drum, has at least one rigid vertical member extending above the coking drum with a toothed rack extending substantially the full height of the member. A rigid frame with provisions for mounting a cutting tool is movably mounted to the rigid vertical member. A motor is mounted to the rigid frame and powers a pinion gear which is drivably engaged on the toothed rack such that rotation of the pinion gear raises or lowers the rigid frame on the vertical member.

7 Claims, 6 Drawing Sheets

DECOKING TOOL CARRIER WITH A SELF-PROPELLED CLIMBING CROSSHEAD

BACKGROUND OF THE INVENTION

This invention relates generally to devices for carrying cutting and drilling tools and more particularly to devices for raising and lowering cutting heads of decoking units for residual oil delayed coking reactors.

In the last phase of petroleum refining, the heavy petroleum remaining is fed into very large coking drums and heated to a temperature sufficient to extract all remaining volatile materials leaving a residue in the drums of solid coke which is substantially free of volatiles. Decoking must be performed on the drums in order to prepare them for further use. Commonly high pressure water jet cutting nozzles are employed to drill and cut the coke sufficiently to allow it to be flushed from the coking drum. The water is supplied to the nozzles at a rate of about 2000 gallons per minute and a pressure of about 3000 pounds per square inch. The cutting nozzle for each coking drum has its own valve fed from a manifold which is fed by an upstream decoking control valve. In addition, a bypass valve is employed, to shunt water back to the jet pump suction tank, for those times when all drums are closed off from the manifold.

Since the coking drums are commonly of the order of 60 to 100 feet high, it is necessary that the water jet cutting head be installed on a drill stem sufficiently long to reach the full vertical extent of the drums. Such long drill stems require an equally long vertical travel for the cutting tool. Thus, it has been common practice to build a decoking tower over each coking drum, to mount the cutting tool on a cutting tool carrier, and to raise and lower the tool carrier and the cutting tool using winches and cables. Towers for supporting such equipment may be as high as 200 feet high, or more, and are very large and heavy. They are not movable. Therefore, each coking drum must have its own tower.

In addition, arresting gear is required to prevent a free fall and to save the tool and other equipment in the event of a cable break or a winch failure. This redundancy adds significantly to the cost of the decoking system without contributing to the efficiency of the actual decoking process.

The foregoing illustrates limitations known to exist in present cutting tool carriers. Thus, it would clearly be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing an apparatus for a decoking system for raising and lowering a cutting tool into a coking drum, comprising at least one rigid vertical member extending above the coking drum and having a toothed rack extending substantially the full height of the member. A rigid frame, having provisions for mounting a cutting tool, is movably mounted to the rigid vertical member. A motor mounted to the rigid frame has means for driving a pinion gear which is drivably engaged on the toothed rack such that rotation of the pinion raises or lowers the rigid frame on the vertical member.

The foregoing and other aspects will become apparent from the following detailed description of the invention when considered in conjunction with the accompanying drawings.

DETAILED DESCRIPTION

Figure 1:
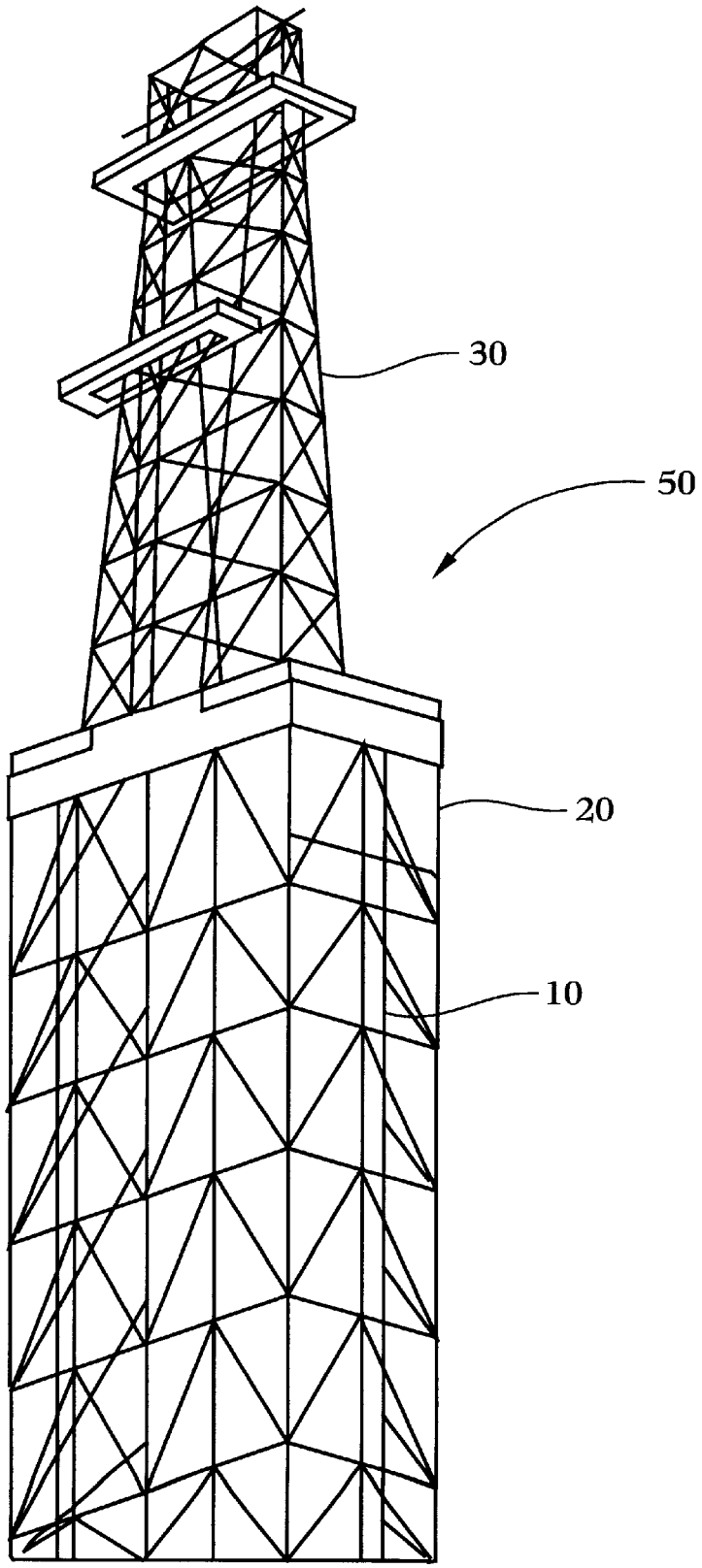
FIG. 1 is a view of a conventional decoking system with its tower and associated coking drum.

FIG. 1 shows a typical decoking system 50 according to the currently available art. The coking drum 10 is surrounded by a tower structure 20 and surmounted by another tower 30. Tower 30 has the winches and cables needed for raising and lowering the high pressure water jet cutting tool for cutting the coke from coking drum 10.

Figure 2:
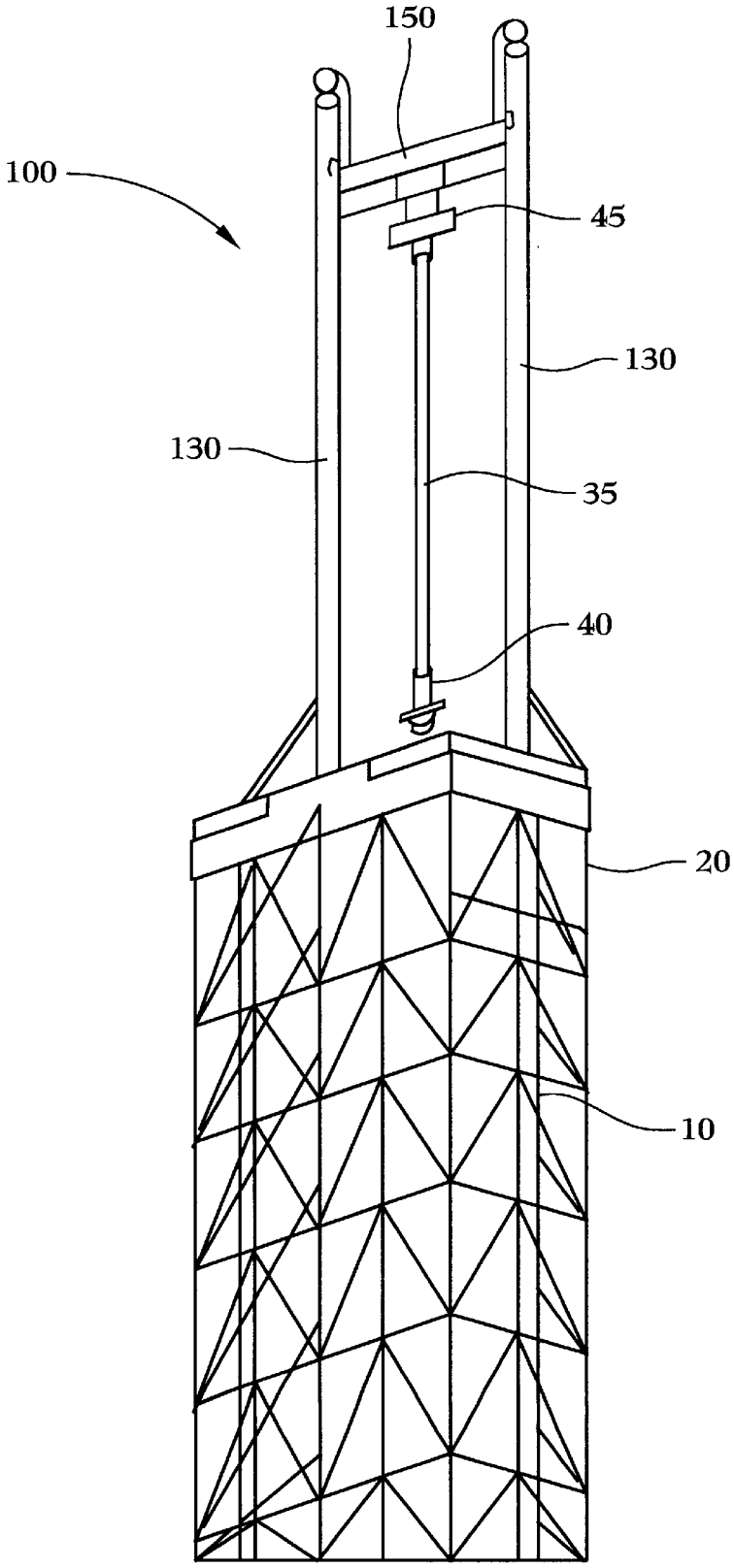
FIG. 2 is a schematic view of a preferred embodiment of the decoking system of the invention.
Figure 3A:
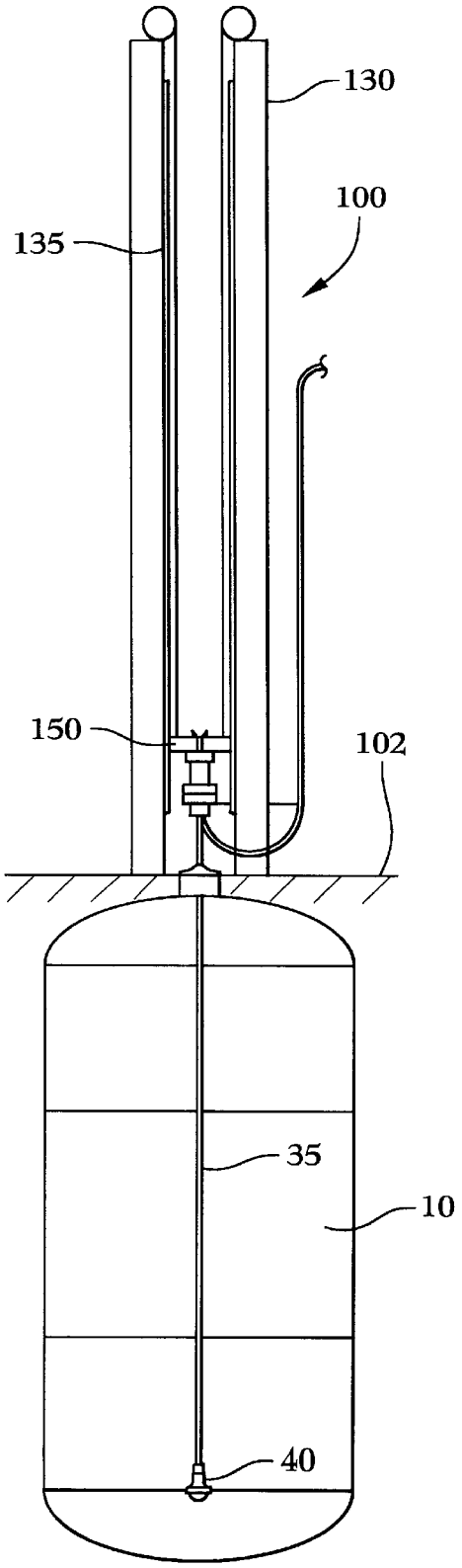
FIGS. 3*a* and 3*b* are schematic illustrations of the decoking system with the cutting tool in lowered and raised positions, respectively.
Figure 3B:
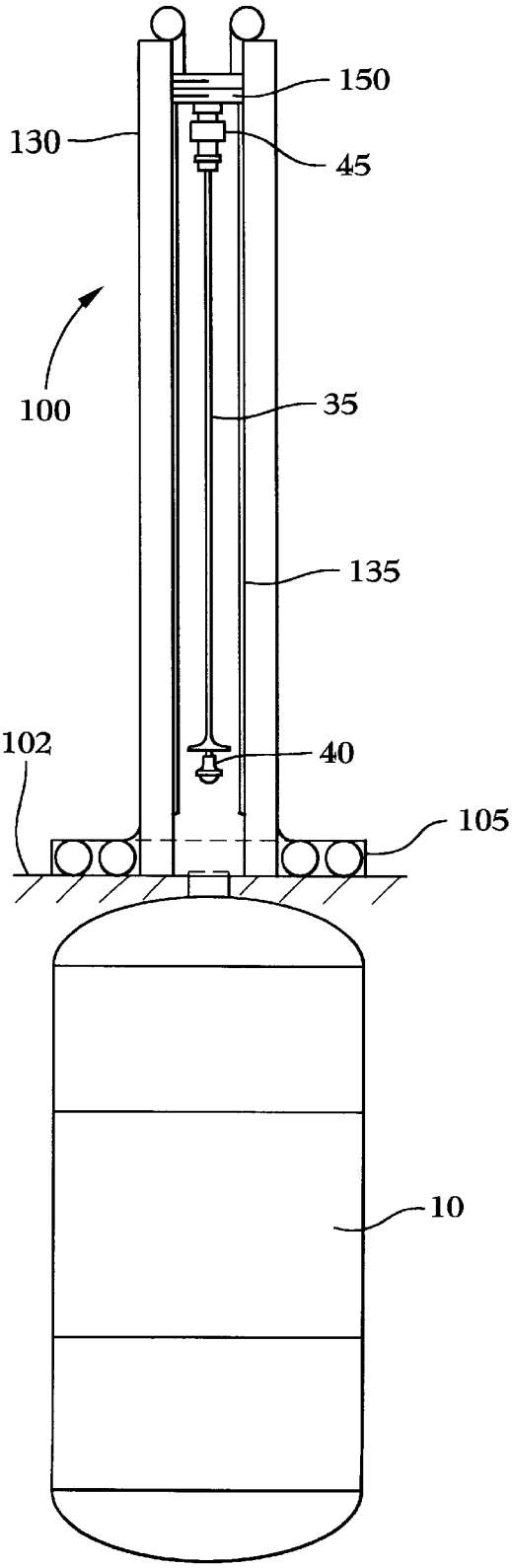

FIG. 2 schematically illustrates a preferred embodiment of the tool carrier 100 with the self-propelled climbing crosshead 150 of the invention. The coking drum 10 is still surrounded by substantially the same tower 20; however, in this case, the upper tower 30, with its winches and cables, has been eliminated and replaced with the tool carrier 100. The tool carrier 100 comprises a rigid climbing crosshead member 150, which is supported on rigid vertical members 130. The crosshead 150 carries a rotary joint 45 which supports a drill stem 35 and a high pressure water jet cutting tool 40 and through which joint water is fed to the cutting tool 40. The vertical members 130 are preferably pipes, for simplicity of construction, but they may be of any form having sufficient rigidity to support the weight of the crosshead 150, the drill stem 35, the cutting tool 40, and all the other equipment borne on the crosshead member. FIGS. 3*a* and 3*b* schematically show the tool carrier of the present invention in lowered and raised positions. Note that FIG. 3*b* shows a wheeled carriage 105 supporting the tool carrier 100. The carriage 105 is used to transport the tool carrier 100 along a track supported on a platform 102 above the coking drums. The platform 102 is supported on towers 20 or equivalent supports, as seen in FIGS. 1 and 2.

Figure 4A:
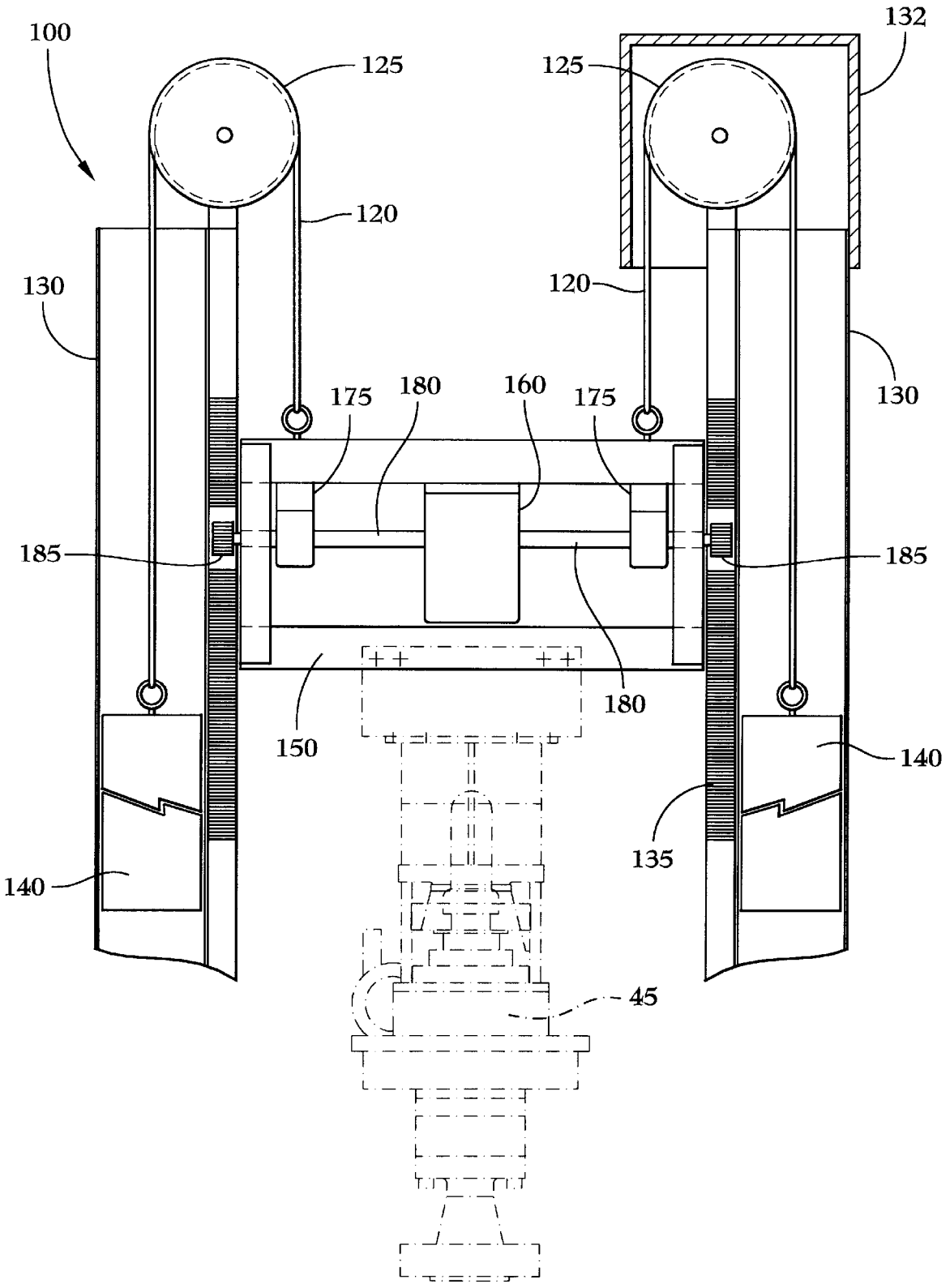
FIGS. 4*a* and 4*b* are schematic front elevation and partially sectional top views of the cutting tool carrier.
Figure 4B:
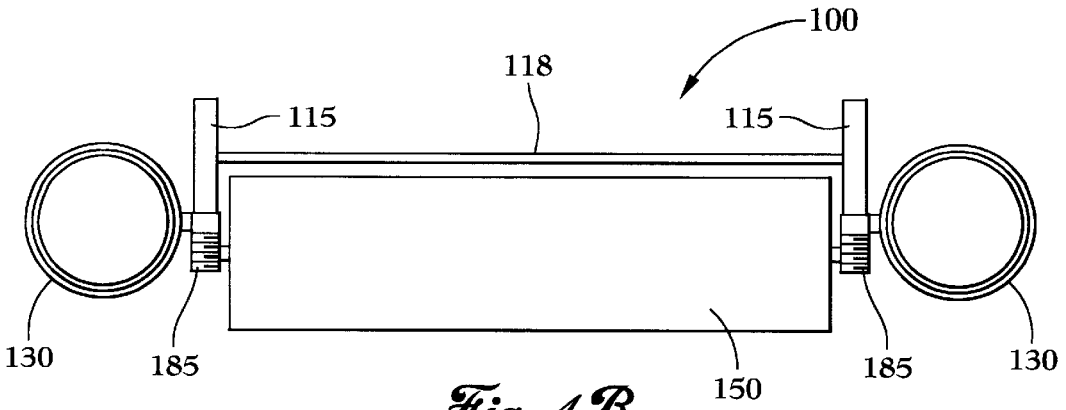
Figure 5:
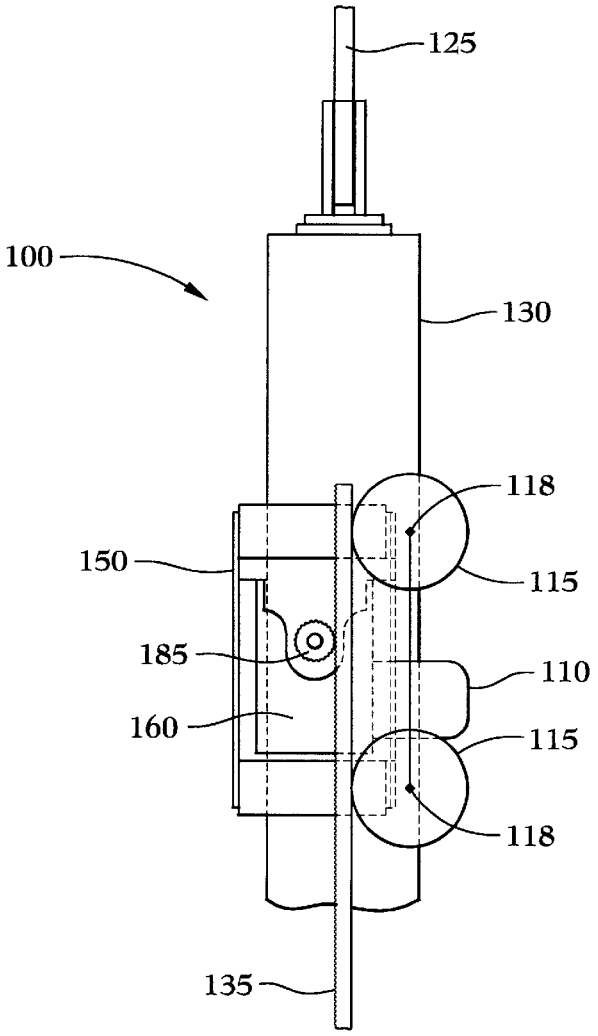
FIG. 5 is a side elevation view of the cutting tool carrier.

Considering FIGS. 4*a,* 4*b,* and 5 will allow a complete understanding of the novel features of the tool carrier 100 and the self-propelled rigid crosshead 150. The rigid crosshead 150 has a motor 110 mounted thereon with a reduction gearbox 160 having a worm gear drivably engaged by a worm on the output shaft of the motor. The worm gear, in the gear box 160, has output shafts 180 carrying pinion gears 185. The output shafts 180 are rotatably supported in bearing blocks 175 so that the pinions 185 are solidly disposed on the crosshead 150. The rotary joint 45 is mounted below the crosshead 150 between the two vertical members 130. Two vertical toothed racks 135, one on each rigid vertical member 130, are engaged by the pinions 185 such that rotation of the pinions 185 causes the crosshead 150 to climb or to descend on the toothed racks 135. The pinions 185 are kept in engagement with the racks 135 by means of clinching wheels 115 mounted on axles 118 and bearing against the rear surfaces of the racks 135. Two cables 120 are attached to the top surface of the rigid crosshead member 150 and extend upward over pulleys 125 and thence downward to counterweights 140 which are preferably within the pipes 130. Pipe caps 132 (only one of which is illustrated in FIG. 4*a*) cover the pulleys 125 and the open ends of the pipes 130 to protect against entry of dirt, debris, and moisture into the pipes. By properly balancing the weight of the crosshead 150 and all the equipment supported by the crosshead, it is possible to power the crosshead using a very small motor 110.

Figure 6:
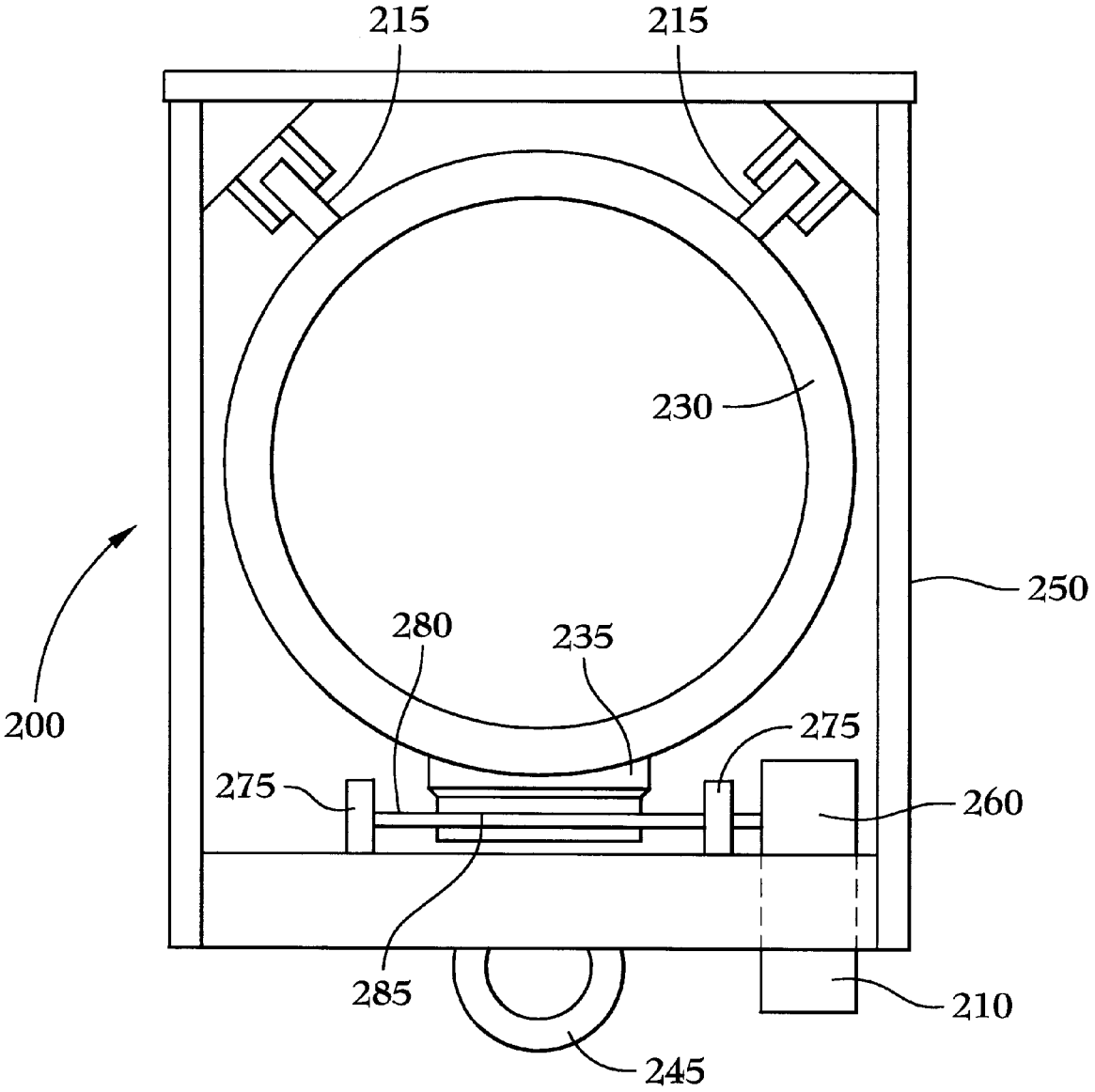
FIG. 6 is a schematic top view of an alternative embodiment of the invention.

An alternative embodiment of the tool carrier 200 is shown in FIG. 6, in which a single rigid vertical member 230 supports a rigid frame member 250. Frame member 250 carries a rotary joint 245 for supporting the drill stem as in the case of rotary joint 45 of the preferred embodiment. A motor 210 drives a worm which engages a worm gear in a gearbox 260 to turn a pinion 285 whose shaft 280 is rotatably supported in bearing blocks 275 on frame member 250. Pinion 285 is engaged with a rack 235 which extends vertically along the rigid vertical member 230. Clinching wheels 215, supported on the frame 250 against the rear surface of the vertical member 230, maintain the pinion 285 always in firm engagement with the rack 236. A wire rope (or cable), pulley, pipe cap, and counterweight, similar to those seen in FIGS. 2–5, is also included in this embodiment. Thus, in all ways, this alternative embodiment operates as does the preferred embodiment of FIGS. 2–5.

The rigid vertical members 130, 230 are preferably made from pipes because of their inherent rigidity and ease of manufacture. By inclusion of the pipe caps, they also can offer protection from the elements and from dirt, debris, and other contaminants. Because of the inherently lighter weight of the tool carrier of this invention, it is possible to mount the carrier on a wheeled carriage for transportation along a track on a platform above a plurality of coking drums. This enables decoking to be accomplished in several coking drums using a single decoking tool. The resulting economies realized by savings on valves, tools, and supporting towers, together with the reduced maintenance requirements provides rapid payback for the installation.

Having described the invention, we claim:

1. An apparatus for a decoking system for raising and lowering a cutting tool into a coking drum, comprising:

a rigid vertical member extending above said coking drum and having a toothed rack extending substantially the full height of said member;

a rigid frame movably mounted to said rigid vertical member, said rigid frame having means for mounting a cutting tool;

a motor mounted to said rigid frame and having means for driving at least one pinion gear, said at least one pinion gear being drivably engaged on said toothed rack such that rotation of said pinion raises or lowers said rigid frame on said rigid vertical member;

a pulley mounted near the top of said rigid vertical member; and a flexible cable fixed to a top surface of said rigid frame and extending over said pulley to a counterweight, said counterweight substantially balancing the weight of the movable rigid frame and all components carried thereon.

2. The apparatus of claim 1, wherein said rigid vertical member comprises a pipe having a sufficiently heavy wall to support the movable rigid frame, the counter weight and all components carried thereon.

3. The apparatus of claim 1, further comprising:

means for moving said rigid vertical member to locate it over any one of a plurality of coking drums.

4. The apparatus of claim 3, wherein the means for moving said rigid vertical member comprises a wheeled carriage disposed beneath said rigid vertical member for transporting said rigid vertical member along a track extending along a platform supported above said plurality of coking drums on towers surrounding said coking drums.

5. The apparatus of claim 1, wherein the means for driving a pinion gear comprises a worm on an output shaft of the motor, said worm drivably engaging a worm gear in a gear box to rotate at least one shaft carrying the at least one pinion gear.

6. In a decoking system of the type having a high pressure water jet cutting tool rotatably mounted on a drill stem suspended from a tool carrier mounted on a rigid vertical member extending above a coking drum, said tool carrier comprising:

a toothed rack extending substantially the full height of said rigid vertical member;

a rigid frame movably mounted to said rigid vertical member;

a motor mounted to said rigid frame and having means for driving at least one pinion gear, said at least one pinion gear being drivably engaged on said toothed rack such that rotation of said pinion raises or lowers said rigid frame on said vertical member;

a pulley mounted near the top of said rigid vertical member; and a flexible cable fixed to said rigid frame and extending over said pulley to a counterweight, said counterweight substantially balancing the weight of the movable rigid frame and all components carried thereon.

7. The tool carrier of claim 6, wherein the means for driving said at least one pinion gear comprises a worm on an output shaft from said motor, said worm drivably engaging a worm gear in a gearbox, said worm gear carrying at least one pinion drive shaft extending from said gearbox.

* * * * *